US009444192B2

(12) United States Patent
Wang et al.

(10) Patent No.: US 9,444,192 B2
(45) Date of Patent: Sep. 13, 2016

(54) COMMUNICATION CONNECTOR AND ELECTRONIC DEVICE USING COMMUNICATION CONNECTOR

(71) Applicant: HUAWEI TECHNOLOGIES CO., LTD., Shenzhen, Guangdong (CN)

(72) Inventors: Zewen Wang, Shenzhen (CN); Congtu Xiao, Shenzhen (CN); Yun Wang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 14/532,403

(22) Filed: Nov. 4, 2014

(65) Prior Publication Data

US 2015/0056828 A1 Feb. 26, 2015

Related U.S. Application Data

(63) Continuation of application No. PCT/CN2013/081405, filed on Aug. 13, 2013.

(30) Foreign Application Priority Data

Aug. 13, 2012 (CN) ..... 2012 1 0286408

(51) Int. Cl.

| | |
|---|---|
| ***H01R 13/648*** | (2006.01) |
| ***H01R 13/6581*** | (2011.01) |
| ***H01R 13/6587*** | (2011.01) |
| ***H01R 9/24*** | (2006.01) |

(Continued)

(52) U.S. Cl.

CPC ..... *H01R 13/6581* (2013.01); *H01R 9/24* (2013.01); *H01R 13/6587* (2013.01); *H01R 12/722* (2013.01); *H01R 23/688* (2013.01)

(58) Field of Classification Search

CPC ..... H01R 23/688
USPC ..... 439/607.05
See application file for complete search history.

(56) References Cited

U.S. PATENT DOCUMENTS

| | | | |
|---|---|---|---|
| 6,120,306 | A | 9/2000 | Evans |
| 6,572,410 | B1 | 6/2003 | Volstorf et al. |
| 6,652,318 | B1 | 11/2003 | Winings et al. |

(Continued)

FOREIGN PATENT DOCUMENTS

| | | | |
|---|---|---|---|
| CN | 1586026 | A | 2/2005 |
| CN | 1633736 | A | 6/2005 |

(Continued)

*Primary Examiner* — Tho D Ta
(74) *Attorney, Agent, or Firm* — Huawei Technologies Co., Ltd.

(57) ABSTRACT

A connector includes one insulator, conductive contacts fixed through the insulator, and wire bodies that are in respectively one-to-one connection to the conductive contacts. The conductive contacts are arranged in arrays to form several conductive contact arrays, each conductive contact array includes several conductive contact groups, and each conductive contact group includes two differential contacts and one earth contact, where wire bodies connected to each conductive contact array form a wire body array, and wire bodies connected to each conductive contact group form a wire body group. The communication connector further includes several shielding pieces, where the shielding pieces are disposed between two neighboring wire body arrays two neighboring wire body arrays, each shielding piece is not conductively connected to any object, and each shielding piece covers only one wire body group.

16 Claims, 6 Drawing Sheets

(51) Int. Cl.
*H01R 12/50* (2011.01)
*H01R 12/72* (2011.01)

(56) References Cited

U.S. PATENT DOCUMENTS

| | | | | |
|---|---|---|---|---|
| 6,692,272 | B2 | 2/2004 | Lemke et al. | |
| 6,808,419 | B1 | 10/2004 | Korsunsky et al. | |
| 6,976,886 | B2 | 12/2005 | Winings et al. | |
| 6,988,902 | B2 | 1/2006 | Winings et al. | |
| 6,994,569 | B2 | 2/2006 | Minich et al. | |
| 7,090,501 | B1 | 8/2006 | Scherer et al. | |
| 7,114,964 | B2 | 10/2006 | Winings et al. | |
| 7,118,391 | B2 | 10/2006 | Minich et al. | |
| 7,182,643 | B2 | 2/2007 | Winings et al. | |
| 7,229,318 | B2 | 6/2007 | Winings et al. | |
| 7,309,239 | B2 | 12/2007 | Shuey et al. | |
| 7,331,800 | B2 | 2/2008 | Winings et al. | |
| 7,390,200 | B2 | 6/2008 | Shuey et al. | |
| 7,390,218 | B2 | 6/2008 | Smith et al. | |
| 7,442,054 | B2 | 10/2008 | Lemke et al. | |
| 7,462,924 | B2 | 12/2008 | Shuey | |
| 7,467,955 | B2 | 12/2008 | Raistrick et al. | |
| 7,581,990 | B2 * | 9/2009 | Kirk | H01R 13/514 439/607.05 |
| 7,621,760 | B1 | 11/2009 | Barr et al. | |
| 2004/0097112 | A1 | 5/2004 | Minich et al. | |
| 2006/0024983 | A1 | 2/2006 | Cohen et al. | |
| 2007/0054554 | A1 * | 3/2007 | Do | H01R 23/688 439/607.05 |
| 2008/0248659 | A1 | 10/2008 | Cohen et al. | |
| 2008/0248693 | A1 | 10/2008 | Winings et al. | |
| 2010/0022130 | A1 | 1/2010 | Barr et al. | |
| 2012/0003872 | A1 | 1/2012 | Pan | |

FOREIGN PATENT DOCUMENTS

| | | | |
|---|---|---|---|
| CN | 2735594 | Y | 10/2005 |
| CN | 1833339 | A | 9/2006 |
| CN | 101180776 | A | 5/2008 |
| CN | 101262105 | A | 9/2008 |
| CN | 101586026 | A | 11/2009 |
| CN | 102106046 | A | 6/2011 |
| CN | 102801053 | A | 11/2012 |

* cited by examiner

COMMUNICATION CONNECTOR AND ELECTRONIC DEVICE USING COMMUNICATION CONNECTOR

CROSS-REFERENCE TO RELATED APPLICATIONS

This application is a continuation of International Application No. PCT/CN2013/081405, filed on Aug. 13, 2013, which claims priority to Chinese Patent Application No. 201210286408.0, filed on Aug. 13, 2012, both of which are hereby incorporated by reference in their entireties.

TECHNICAL FIELD

The present invention relates to the field of communications, and in particular, to a communication connector and an electronic device using the communication connector.

BACKGROUND

A signal cable is required for transmission between communication devices, and a communication connector is required for connection between the signal cable and a communication device. However, communication between the communication devices relates to multiple signals, while a connector, generally small in volume, has many joints corresponding to various signals, and a distance between each joint and each signal is relatively short. Crosstalk between the joints may severely affect communication quality. Therefore, a crosstalk problem of the communication connector needs to be effectively solved.

SUMMARY

Embodiments of the present invention provide a communication connector that can effectively solve a crosstalk problem and an electronic device using the communication connector.

In one aspect, an embodiment of the present invention provides a communication connector, including one insulator, conductive contacts fixed through the insulator, and wire bodies that are in respectively one-to-one connection to the conductive contacts, where the conductive contacts include a differential contact used to transmit a differential signal and an earth contact used for grounding. The conductive contacts are arranged in arrays to form several conductive contact arrays, each conductive contact array includes several conductive contact groups, and each conductive contact group includes two differential contacts and one earth contact, where wire bodies connected to each conductive contact array form a wire body array, and wire bodies connected to each conductive contact group form a wire body group. The communication connector further includes several shielding pieces, where the shielding pieces are disposed between two neighboring wire body arrays, each shielding piece is not conductively connected to any object, and each shielding piece covers only one wire body group.

In another aspect, the embodiments of the present invention provide an electronic device, including a circuit board and a connector installed on the circuit board, where the connector includes one insulator, conductive contacts fixed through the insulator, and wire bodies that are in respectively one-to-one connection to the conductive contacts. The conductive contacts are arranged in arrays to form several conductive contact arrays, each conductive contact array includes several conductive contact groups, and each conductive contact group includes two differential contacts used to transmit a differential signal and one earth contact, where wire bodies connected to each conductive contact array form a wire body array, and wire bodies connected to each conductive contact group form a wire body group. The communication connector further includes several shielding pieces, where the shielding pieces are disposed between two neighboring wire body arrays two neighboring wire body arrays, each shielding piece is not conductively connected to any object, and each shielding piece covers only one wire body group.

By disposing a shielding piece between two conductor groups of two neighboring wire body arrays that are respectively connected to two neighboring conductive contact arrays, the foregoing communication connector or the connector of the electronic device may significantly reduce signal interference between two neighboring conductive contact arrays during transmission, and therefore effectively solve a crosstalk problem between multiple signals of a high-speed communication connector, thereby ensuring quality of signal transmission in a high-speed scenario.

Figure 1:
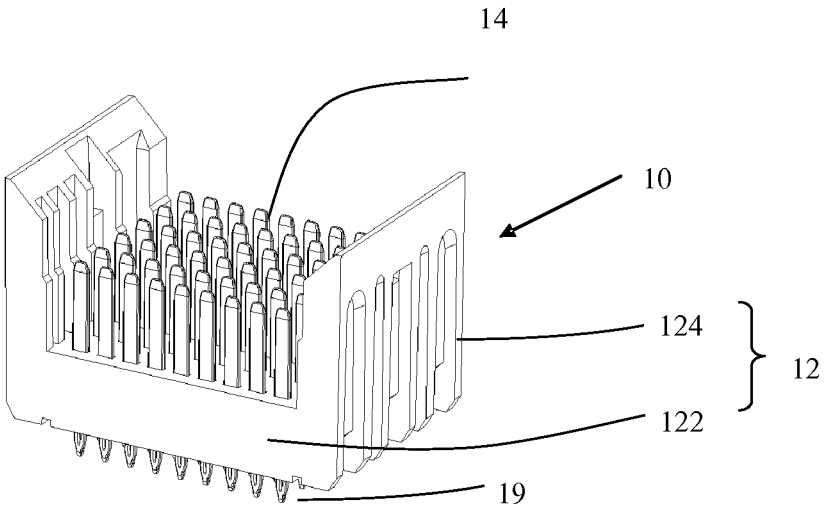
FIG. 1 is a three-dimensional view of a communication connector according to a first embodiment of the present invention.

To describe the technical solutions in the embodiments of the present invention more clearly, the following briefly introduces the accompanying drawings required for describing the embodiments. Apparently, the accompanying drawings in the following description show merely some embodiments of the present invention. In addition, for a better understanding of the present invention, some specific positional terms are used in the following description of embodiments, such as "up", "down", "inside", and "outside", which are merely designated for displaying in the accompanying drawings with reference to specific embodiments of the present invention, and shall not be understood as a limitation on the embodiments of the present invention.

DESCRIPTION OF EMBODIMENTS

The following clearly describes the technical solutions in the embodiments of the present invention with reference to the accompanying drawings in the embodiments of the present invention. Apparently, the described embodiments are merely a part rather than all of the embodiments of the present invention. All other embodiments obtained by persons of ordinary skill in the art based on the embodiments of the present invention without creative efforts shall fall within the protection scope of the present invention.

As shown in FIG. 1 to FIG. 12, communication connectors 10 and 20 in a first embodiment of the present invention include insulators 12 and 22, conductive contacts 14 and 24 fixed through the insulators, and wire bodies 16 and 26 in respectively one-to-one connection to the conductive contacts. The conductive contacts 14 and 24 are arranged in arrays to form several conductive contact arrays, each conductive contact array includes several conductive contact groups, and each conductive contact group includes two differential contacts used to transmit a differential signal and one earth contact, where the wire bodies 16 and 26 connected to each conductive contact array form one wire body array, and the wire bodies 16 and 26 connected to each conductive contact group form a wire body group. The communication connector further includes several shielding pieces 18 and 28, where the shielding pieces 18 and 28 are disposed between two neighboring wire body arrays two neighboring wire body arrays, and each shielding piece is not conductively connected to any object and each of the shielding pieces 18 and 28 covers only one wire body group of a same wire body array.

The communication connectors further include pins 19 and 29. The communication connectors may be installed on a circuit board of an electronic device through the pins. The pins are also arranged in arrays to form pin arrays and pin groups respectively corresponding to the conductive contact arrays and the conductive contact groups. The wire bodies 16 and 26 of each wire body group are respectively in on-to-one connection to the conductive contacts 14 and 24 of one conductive contact group and the pins 19 and 29 of one pin group. As being connected to two corresponding conductive contact groups in every two neighboring conductive contact arrays, the two wire body groups are separated by a shielding piece completely, which means that the shielding piece completely separates any conductor group from a surface of another conductor group.

A shape and a size of the shielding pieces 18 and 28 may be adjusted and changed according to specific requirements and situations. As long as the one shielding piece or a combination of multiple shielding pieces completely covers one wire body group and does not cover another wire body group of a same wire body array, a purpose of shielding different arrays in the present invention is achieved. That each shielding piece is not conductively connected to any object means that each shielding piece is neither grounded nor electrically connected to any conductive object. Each wire body group is completely covered by a shielding piece, and the shielding piece that covers one wire body group includes one or multiple shielding pieces. The shielding piece is made of materials with a function of magnetic shielding, which may be metal, such as copper, aluminum, and other metal with a function of electromagnetic shielding.

By disposing a shielding piece between two conductor groups of two neighboring wire body arrays that are respectively connected to two neighboring conductive contact arrays, signal interference between two neighboring conductive contact arrays during transmission may be reduced significantly, and therefore a crosstalk problem between multiple signals of a high-communication connector is solved effectively, thereby ensuring quality of signal transmission in a high-speed scenario. Special reference may be made to FIG. 12, which shows a simulation diagram of crosstalk of a communication connector in the embodiments of the present invention. A dashed line indicates a crosstalk situation of a regular connector, while a solid line indicates a crosstalk situation of a connector in the embodiments of the present invention. It can be seen that, compared with the dashed curve line, the solid curve line is more moderate with a lower peak value, and is more stable in crosstalk, thereby ensuring stability of signal transmission.

Figure 2:
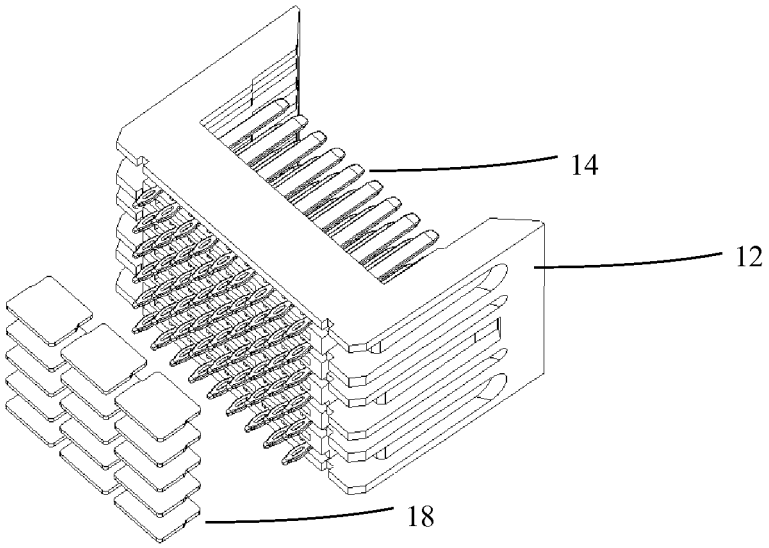
FIG. 2 is an exploded view of a part of a communication connector in FIG. 1.
Figure 3:
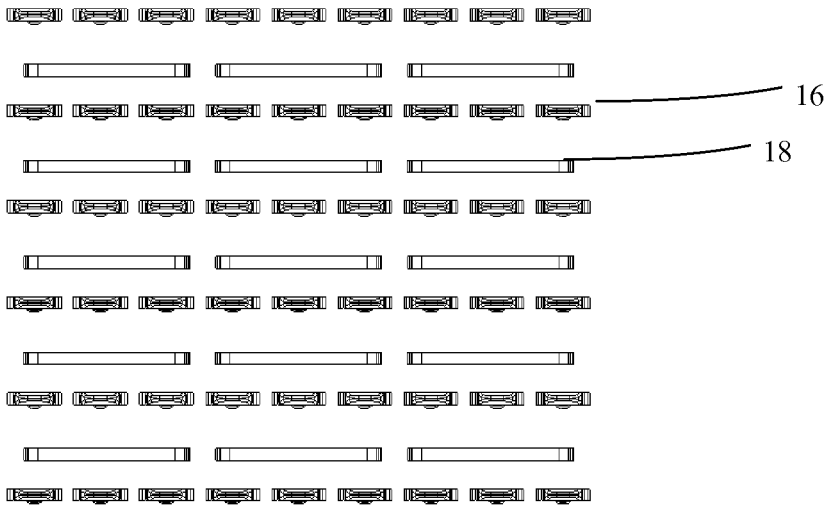
FIG. 3 is a plan view of one side of a communication connector in FIG. 1.
Figure 4:
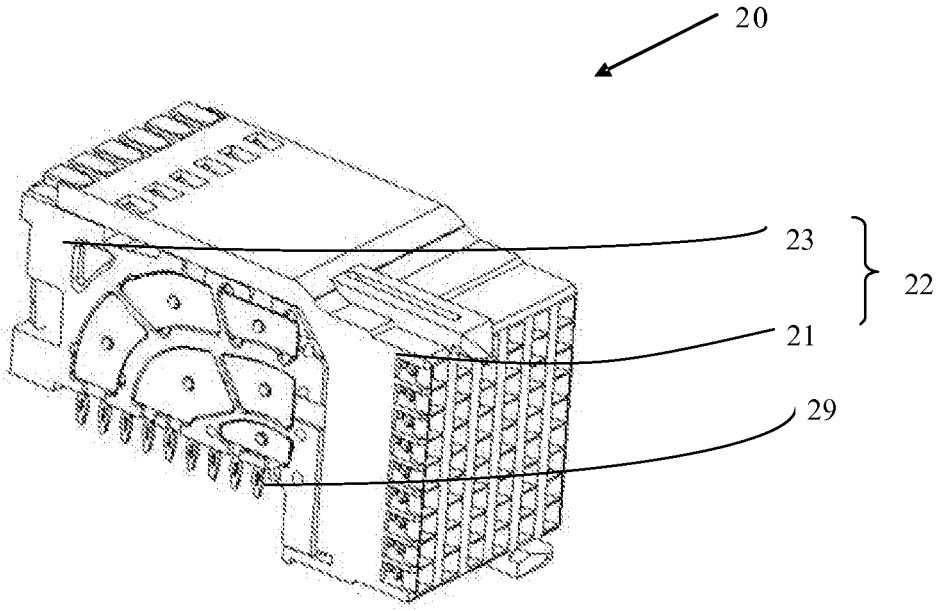
FIG. 4 is a three-dimensional view of a communication connector in a second embodiment according to the embodiments of the present invention.
Figure 5:
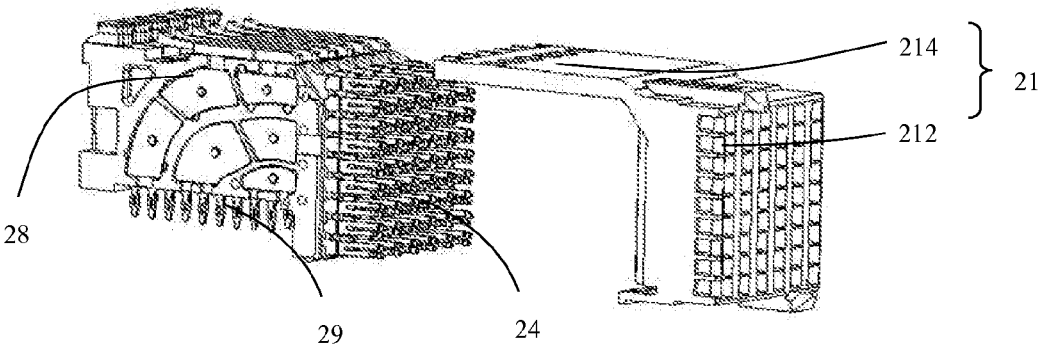
FIG. 5 is an exploded view of a part of a communication connector in FIG. 4.
Figure 6:
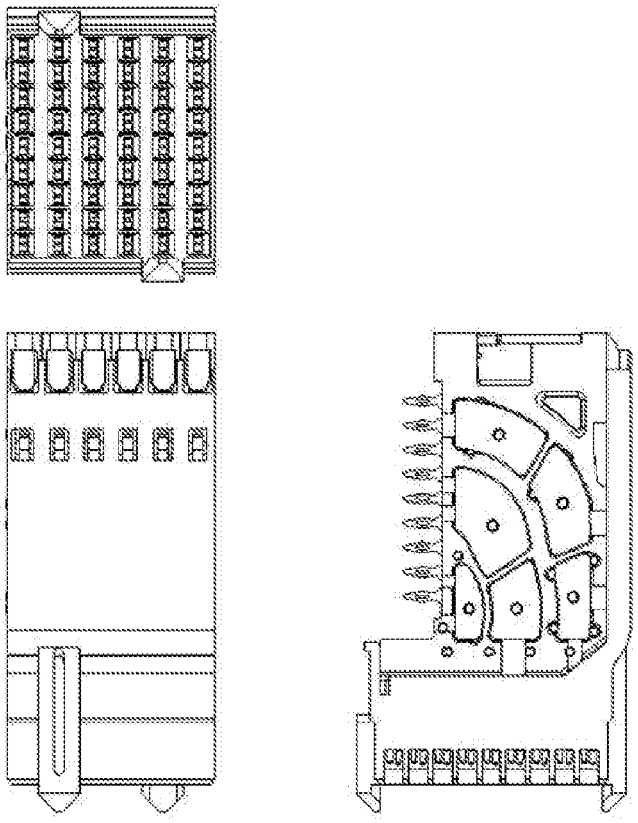
FIG. 6 is an exploded plan view of a part of a communication connector in FIG. 4.
Figure 7:
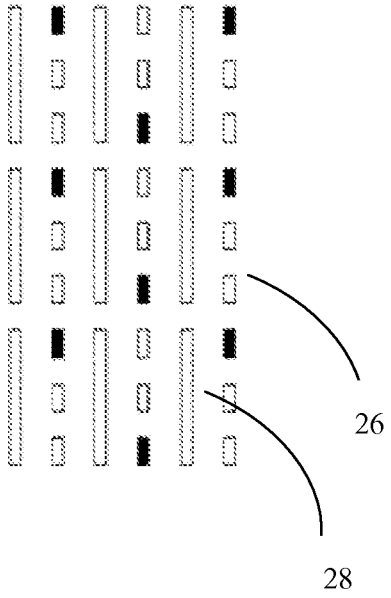
FIG. 7 is a schematic diagram of arrangement of wire bodies and shielding pieces of a communication connector in FIG. 4.
Figure 8:
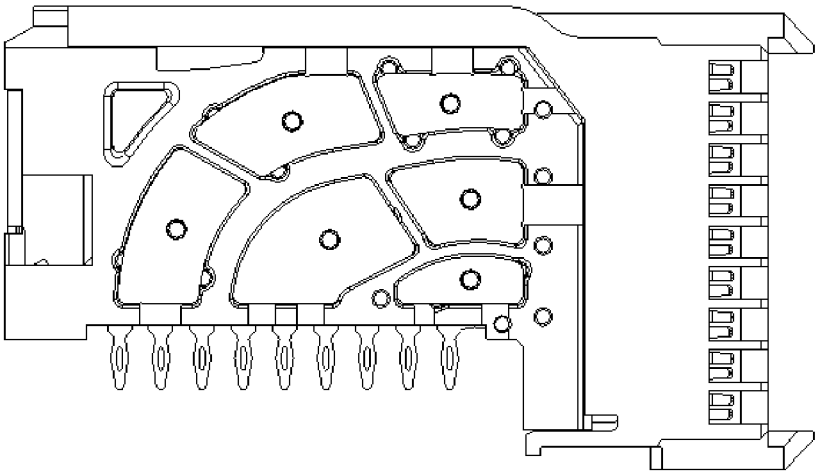
FIG. 8 is a plan view of a terminal sheet layer of a communication connector in FIG. 4.
Figure 9:
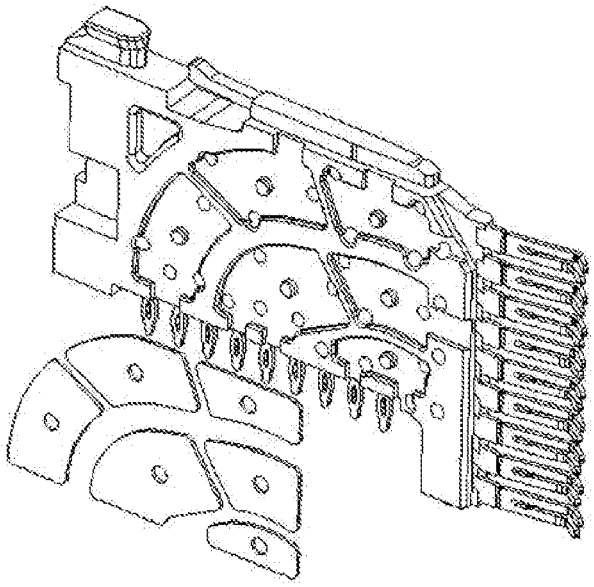
FIG. 9 is an exploded view of a terminal sheet layer of a communication connector in FIG. 4.
Figure 10:
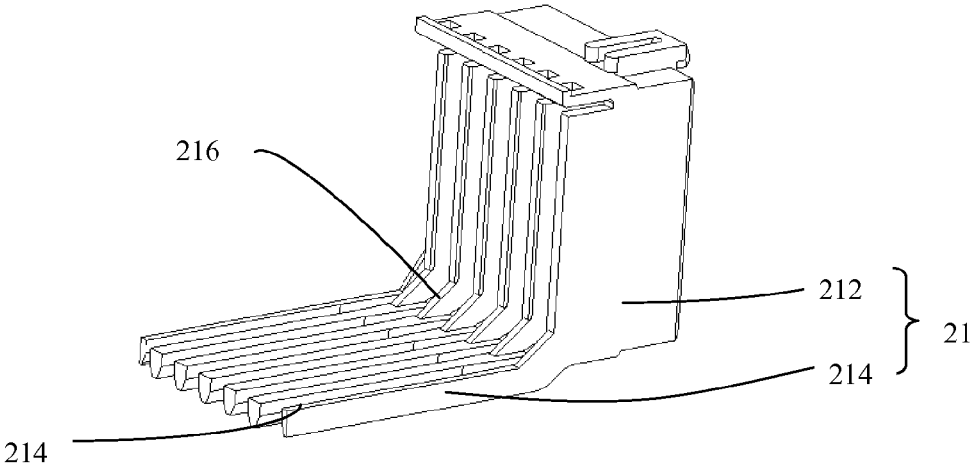
FIG. 10 is a three-dimensional view of a fixing part of a communication connector in FIG. 4.

As shown in FIG. 1 to FIG. 3, a communication connector in a second embodiment of the present invention includes all characteristics of the first embodiment, and further includes the following characteristics: The insulator 12 of the communication connector includes a wiring part 122 and an guiding part 124 extended from two opposite sides of the wiring part 122, where the conductive contacts 14 are disposed on one side of the wiring part 122 to form plug-connected terminals, the wire bodies 16 are embedded in the wiring part 122, and the shielding pieces 18 are also fixed in the wiring part 122 and located between two neighboring wire body arrays.

The pins 19 are disposed on another side of the wiring part 122 that is opposite to the plug-connected terminals, and two opposite sides of the wiring part 122 to which each wire body 16 is perpendicular are connected to one pin 19 and one plug-connected terminal.

Special reference may be made to FIG. 3, where the plug-connected terminals and the pins are separately located at the two opposite sides of the wiring part 122 and are arranged in arrays, the shielding pieces are located between the plug-connected terminals and the pins and are arranged in arrays, and each shielding piece is located between two opposite wire body groups of two neighboring wire body arrays and completely blocks linear connection between the two opposite wire body groups, that is, a surface of any one of the two opposite wire body groups in the two neighboring wire body arrays that is facing another wire body group is covered by the shielding piece, thereby shielding magnetic interference between the wire body groups.

As shown in FIG. 4 to FIG. 10, the communication connector in the second embodiment of the present invention includes all characteristics of the first embodiment, and further includes the following characteristics: The insulator 22 includes a fixing frame 21 and several terminal sheet layers 23 fixed through the fixing frame 21, where each conductive contact array is disposed on one side of a terminal sheet layer to form a contact terminal array, a wire body array connected to the contact terminal array is embedded in the terminal sheet layer 23, the terminal sheet layers 23 are stacked, and the shielding piece 28 covers one surface of the two opposite surfaces of two neighboring terminal sheet layers.

Each conductive contact group correspondingly forms a contact terminal group, pins 29 are disposed on another side of the terminal sheet layers 23, each wire body group on each terminal sheet layer 23 is in one-to-one connection to three contact terminals 24 of one terminal group of the same terminal sheet layer 23 and three neighboring pins 29, and the wire body group is completely covered implemented by one or multiple shielding pieces 28, where the multiple shielding pieces 28 are arranged along a track of cabling of the wire body group.

The contact terminal array is disposed on one side of a terminal sheet layer, the pins are disposed on another neighboring side of the terminal sheet layer, and the wire body group is extended in an arc from the contact terminal array on the one side of the terminal sheet layer to the pins on another side of the terminal sheet layer. In addition, if the pins connected to the wire body group are farther from the contact terminal array on the one side of the terminal sheet layer, the wire body group is longer and more shielding pieces cover the wire body group.

In the embodiment, each terminal sheet layer includes three contact terminal groups, three wire body groups, and nine pins, where the shielding pieces are grouped into three groups, and a quantity in each group may be one, two, or three according to lengths of the wire body groups. It may be understood that, the quantities of the foregoing terminal groups, wire body groups, and pins are not limited and may be set according to specific requirements, as long as the quantities of the contact terminals 24, the wire bodies 26, and the pins 29 are consistent. In addition, a quantity of the shielding pieces 28 is also not limited, provided that a condition that a same shielding piece does not cross the wire body groups of different differential pairs is met. A quantity of the shielding pieces covering a same wire body group may be chosen to be a combination of shielding pieces with a highest coverage rate or a single shielding piece according to an extension length and a track of the wire body group.

The fixing frame 21 includes one wiring part 212 and a fixing part 214 extended from one side of the wiring part 212, where the contact terminals 24 on one side of the terminal sheet layer 23 are inserted in the wiring part 212, and the terminal sheet layers 23 are stacked and fixed together through the fixing part 214.

A conduit is formed in the fixing part 214, and a bracket that is inserted into the conduit for fixing is disposed on another side of the terminal sheet layer that is opposite to the pins. An outlet part is disposed on a corner connected by the fixing part and the wiring part, forming a reinforcing rib 216 for the fixing part and the wiring part, where the reinforcing rib is triangular.

Figure 11:
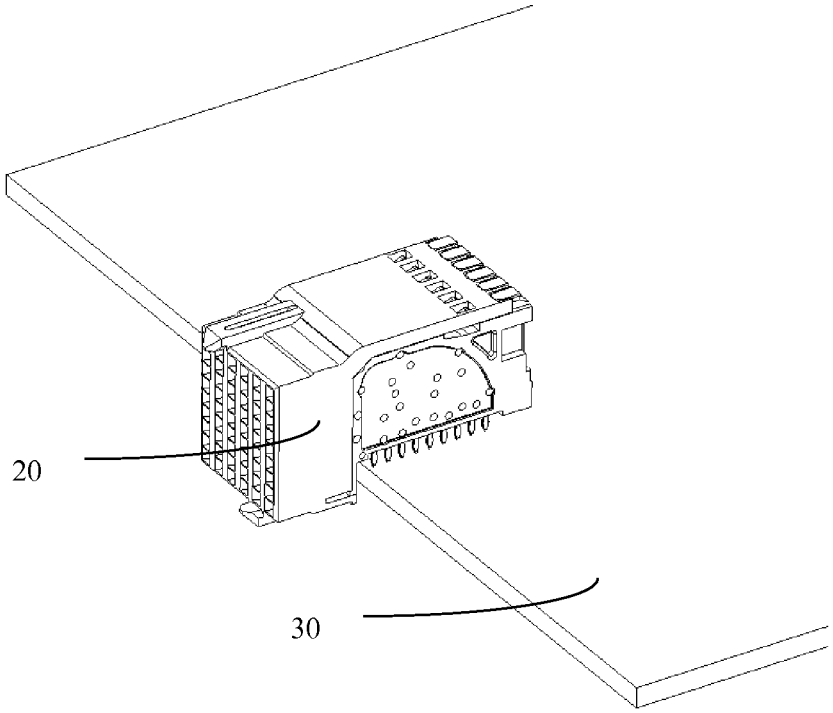
FIG. 11 is a schematic diagram of an electronic device in a third embodiment according to the embodiments of the present invention.
Figure 12:
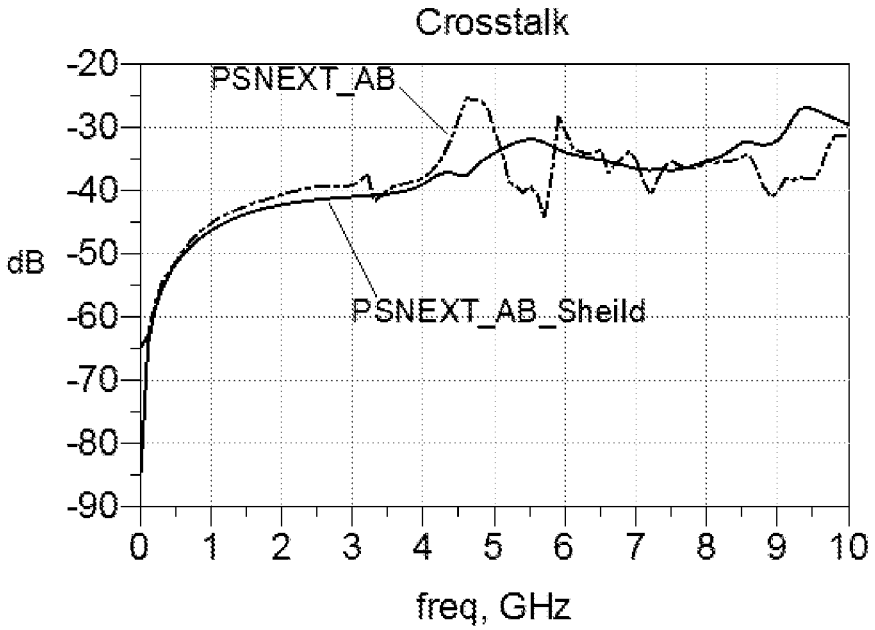
FIG. 12 is a simulation effect diagram of a communication connector or a connector in an embodiment according to the embodiments of the present invention.

As shown in FIG. 11, an electronic device includes a circuit board 30 and a connector 20 installed on the circuit board, where the connector 20 may be any one of the communication connectors in the foregoing first to third embodiments. For example, according to the second embodiment, the connector 20 includes one insulator, conductive contacts fixed through the insulator, and wire bodies that are in respectively one-to-one connection to the conductive contacts. The conductive contacts are arranged in arrays to form several conductive contact arrays, each conductive contact array includes several conductive contact groups, and each conductive contact group includes two differential contacts used to transmit a differential signal and one earth contact, where wire bodies connected to each conductive contact array form a wire body array, and wire bodies connected to each conductive contact group form a wire body group. The communication connector further includes several shielding pieces, where the shielding pieces are disposed between two neighboring wire body arrays two neighboring wire body arrays, each shielding piece is not conductively connected to any object, and each shielding piece covers only one wire body group.

That each shielding piece is not conductively connected to any object means that each shielding piece is neither grounded nor electrically connected to any conductive object.

Each of the wire body groups is completely covered by a shielding piece, and the shielding piece that covers one wire body group includes one or multiple shielding pieces.

Finally, it should be noted that the foregoing embodiments are merely intended for describing the technical solutions of the present invention other than limiting the present invention. Although the present invention is described in detail with reference to exemplary embodiments, persons of ordinary skill in the art should understand that they may still make modifications or equivalent replacements to the technical solutions in the embodiments of the present invention, provided that such modifications or equivalent replacements do not cause the modified technical solutions to depart from the scope of the technical solutions of the embodiments of the present invention.

What is claimed is:

1. A communication connector, comprising:

an insulator;

conductive contacts fixed through the insulator, with the conductive contacts comprising differential contacts used to transmit a differential signal and earth contacts used for grounding, with the conductive contacts arranged in arrays to form several conductive contact arrays, each conductive contact array comprises several conductive contact groups, each conductive contact group comprises two differential contacts and one earth contact;

wire bodies in one-to-one connection to the conductive contacts, with the wire bodies connected to each conductive contact array to form a wire body array and with the wire bodies connected to each conductive contact group to form a wire body group; and shielding pieces fixed through the insulator, with the shielding pieces disposed between two neighboring wire body arrays, wherein each shielding piece is not conductively connected to any object and each shielding piece covers only one wire body group.

2. The communication connector according to claim 1, wherein that each shielding piece is not conductively connected to any object means that each shielding piece is neither grounded nor electrically connected to any conductive object, and the shielding pieces are fixed between the two neighboring wire body arrays.

3. The communication connector according to claim 1, wherein each of the wire body groups is completely covered by the shielding pieces, and one or multiple ones of the shielding pieces that covers one wire body group.

4. The communication connector according to claim 1, wherein the insulator comprises one wiring part and a guiding part extended from two opposite sides of the wiring part, the conductive contacts are disposed on one side of the wiring part to form plug-connected terminals, the wire bodies are embedded in the wiring part, and the shielding pieces are also fixed in the wiring part and located between two neighboring wire body arrays.

5. The communication connector according to claim 4, wherein pins are disposed on another side of the wiring part that is opposite to the plug-connected terminals, and one pin and one plug-connected terminal are connected to each wire body that is perpendicular to two opposite sides of the wiring part.

6. The communication connector according to claim 5, wherein the plug-connected terminals and the pins are separately located at the two opposite sides of the wiring part and are arranged in arrays, the shielding pieces are located between the plug-connected terminals and the pins and are arranged in arrays, and each shielding piece is located between two opposite wire body groups of two neighboring wire body arrays and completely blocks linear connection between the two opposite wire body groups.

7. The communication connector according to claim 1, wherein the insulator comprises a fixing frame and several terminal sheet layers fixed through the fixing frame, each conductive contact array is disposed on one side of a terminal sheet layer to form a contact terminal array, a wire body array connected to the contact terminal array is embedded in the terminal sheet layer, the terminal sheet layers are stacked, and the shielding piece covers one surface of the two opposite surfaces of two neighboring terminal sheet layers.

8. The communication connector according to claim 7, wherein each conductive contact group correspondingly forms a contact terminal group, pins are disposed on another side of the terminal sheet layers, each wire body group on each terminal sheet layer are in one-to-one connection to three contact terminals of one terminal group of the same terminal sheet layer and three neighboring pins, complete covering of the wire body group is implemented by one or multiple shielding pieces, and the multiple shielding pieces are arranged along a track of cabling of the wire body group.

9. The communication connector according to claim 8, wherein the contact terminal array is disposed on one side of a terminal sheet layer, the pins are disposed on another neighboring side of the terminal sheet layer, the wire body group is extended in an arc from the contact terminal array on the one side of the terminal sheet layer to the pins on another side of the terminal sheet layer, and if the pins connected to the wire body group are farther from the contact terminal array on the one side of the terminal sheet layer, the wire body group is longer, and more shielding pieces cover the wire body group.

10. The communication connector according to claim 9, wherein each terminal sheet layer comprises three contact terminal groups, three wire body groups, and nine pins, the shielding pieces are grouped into three groups, and a quantity may be one, two, or three according to lengths of the wire body groups.

11. The communication connector according to claim 7, wherein the insulator comprises one wiring part and a fixing part extended from one side of the wiring part, the contact terminals on one side of the terminal sheet layer are inserted in the wiring part, and the terminal sheet layers are stacked and fixed together through the fixing part.

12. The communication connector according to claim 11, wherein a conduit is formed in the fixing part, and a bracket that is inserted into the conduit is disposed on another side of the terminal sheet layer that is opposite to the pins.

13. The communication connector according to claim 1, wherein the shielding piece is a copper piece.

14. An electronic device, comprising;

a circuit board; and a connector installed on the circuit board, the connector comprising:

an insulator;

conductive contacts fixed through the insulator, with the conductive contacts arranged in arrays to form several conductive contact arrays, each conductive contact array comprises several conductive contact groups, and each conductive contact group comprises two differential contacts used to transmit a differential signal and one earth contact; and wire bodies in one-to-one connection to the conductive contacts, with the wire bodies connected to each conductive contact array form a wire body array, wire bodies connected to each conductive contact group form a wire body group; and shielding pieces fixed through the insulator, with the shielding pieces disposed between two neighboring wire body arrays, each shielding piece is not conductively connected to any object and each shielding piece covers only one wire body group.

15. The electronic device according to claim 14, wherein that each shielding piece is not conductively connected to any object means that each shielding piece is neither grounded nor electrically connected to any conductive object.

16. The electronic device according to claim 14, wherein each of the wire body groups is completely covered by the shielding pieces, and one or multiple ones of the shielding pieces cover one wire body group.

* * * * *